US010493795B1

(12) United States Patent
Walker

(10) Patent No.: US 10,493,795 B1
(45) Date of Patent: Dec. 3, 2019

(54) PAINT CAN APPARATUS

(71) Applicant: Marcus Walker, Memphis, TN (US)

(72) Inventor: Marcus Walker, Memphis, TN (US)

( * ) Notice: Subject to any disclaimer, the term of this patent is extended or adjusted under 35 U.S.C. 154(b) by 0 days.

(21) Appl. No.: 16/106,334

(22) Filed: Aug. 21, 2018

(51) Int. Cl.
*A45F 5/02* (2006.01)
*B44D 3/14* (2006.01)

(52) U.S. Cl.
CPC ..... *B44D 3/14* (2013.01); *A45F 5/021* (2013.01)

(58) Field of Classification Search
CPC .. B44D 3/14; B44D 3/24; B44D 3/121; A45F 5/021; A45F 5/02; A45F 2200/0575; A45F 5/00; A45F 2005/026; A45F 5/10; Y10S 224/904
See application file for complete search history.

(56) References Cited

U.S. PATENT DOCUMENTS 570,339 A 10/1896 Roberts, Jr.
2,236,187 A * 3/1941 Penney ..... B44D 3/14 248/210
2,524,875 A * 10/1950 Beaver ..... B44D 3/14 248/211
2,846,173 A * 8/1958 Grovesteen ..... B44D 3/14 248/210
4,396,174 A * 8/1983 Continenza ..... E06C 7/146 248/211
5,145,226 A * 9/1992 LaFontaine ..... B44D 3/123 248/210
5,511,753 A 4/1996 Lage
6,394,304 B1 5/2002 Bohne et al.
6,557,738 B1 5/2003 Maintzi
9,021,662 B1 5/2015 Jones
9,102,193 B1 8/2015 Mahowald
9,538,834 B2 * 1/2017 Dietmeyer ..... A45F 5/02
9,815,319 B2 11/2017 Cooper
9,931,887 B2 * 4/2018 Eberly, Jr. ..... B44D 3/14
2007/0034761 A1 2/2007 Deboer
2008/0017771 A1 1/2008 Anderson
2014/0263501 A1 9/2014 Bajuyo
2016/0368312 A1 12/2016 Cooper

* cited by examiner

*Primary Examiner* — Adam J Waggenspack
(74) *Attorney, Agent, or Firm* — David J Kreher

(57) ABSTRACT

An apparatus for attaching a can to the belt of a wearer to free the wearer's hands for other work and decrease the risk of injury during such activities as ascending and descending a ladder or maneuvering through a construction site. The apparatus comprising a belt attachment, an upper piece, and a lower piece. The belt attachment and the upper piece may be formed as a single assembly.

18 Claims, 8 Drawing Sheets

PAINT CAN APPARATUS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC

Not Applicable

FIELD OF THE INVENTION

Having to hold a can while ascending or descending a ladder or navigating a construction site increases the risk of harm. In order to decrease this risk of harm, this apparatus attaches to a can and can then be attached to a belt of the wearer. The method of attachment to the can is intended to be simple and secure, ensuring that the paint can cannot be accidently released.

BACKGROUND OF THE INVENTION

Several attempts have been made to design a method of allowing an individual to ascend or descend a ladder without having to simultaneously hold a can. These designs include means of attaching the can to the ladder, designing a belt to hold the can, designing a frame to go around and hold a can, wherein the frame can then be attached to a belt, and various handles that attach to a can to make the can easier to hold.

SUMMARY OF THE INVENTION

The present disclosure reveals an apparatus for attaching a can to a belt comprising a belt attachment portion, an upper piece and a lower piece. The belt attachment portion is attached to the upper piece with the use of rivets, screws, welds, adhesive, or the pelt attachment portion and the upper piece can be formed as a single component. The upper piece attaches to the can with the use of a hook that extends over the top of the can and around the interior lip of the can. The lower piece goes beneath the bottom of the can and attaches to the upper piece with the use of a threaded fastener and either bolt or wing nut.

The apparatus may also comprise a paint brush holder capable of holding a handle of the paint brush with bristles of the brush extend into the can.

In order to prevent slippage when the upper piece is attached to the lower piece, around the threaded fastener and around the hole in the upper piece there may be a plurality of ridges so that when the upper piece and the lower piece are attached together the plurality of ridges add additional friction to prevent the upper piece and the lower piece from sliding.

The offset of the upper area of the lower piece may further comprise a lower edge, said lower edge comprising a notch and being positioned such that a handle of the can is inserted into the notch, holds the lower piece in place against the can, and prevents the handle from flopping around.

DETAILED DESCRIPTION OF THE INVENTION

Figure 1:
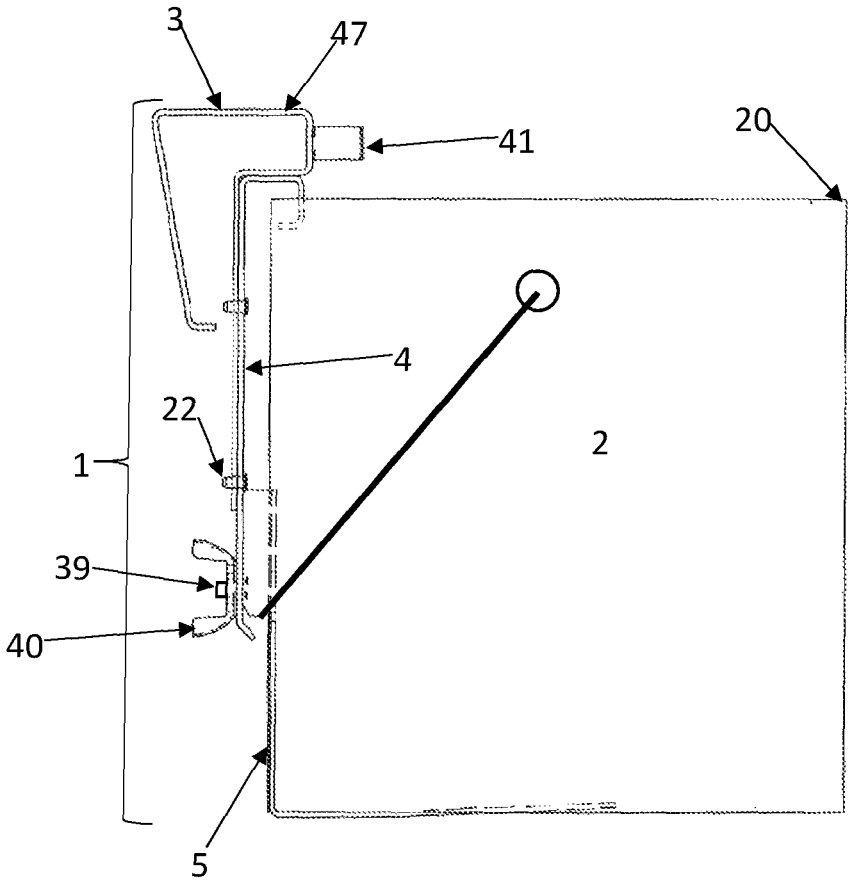
FIG. 1 is a view of the paint can holding apparatus attached to a can.
Figure 2:
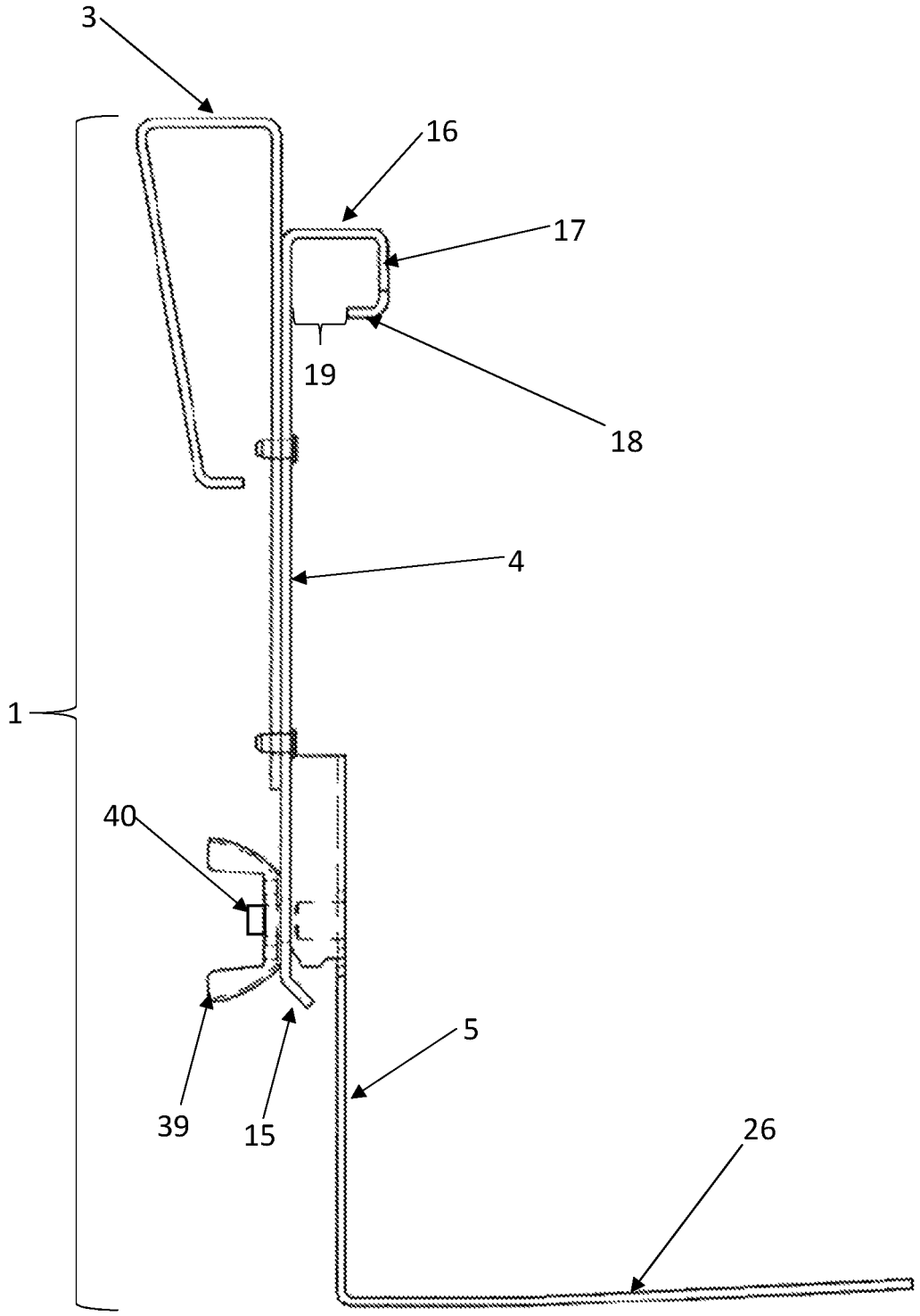
FIG. 2 is a view of the paint can holding apparatus including the belt attachment, the upper piece, and the lower piece.
Figure 3A:
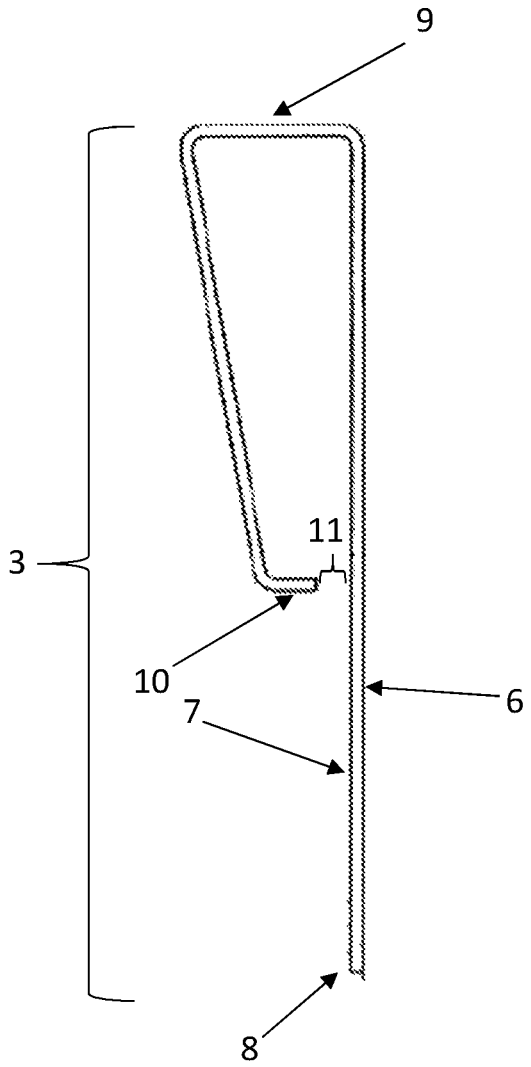
FIG. 3A is a view of the belt attachment.
Figure 3B:
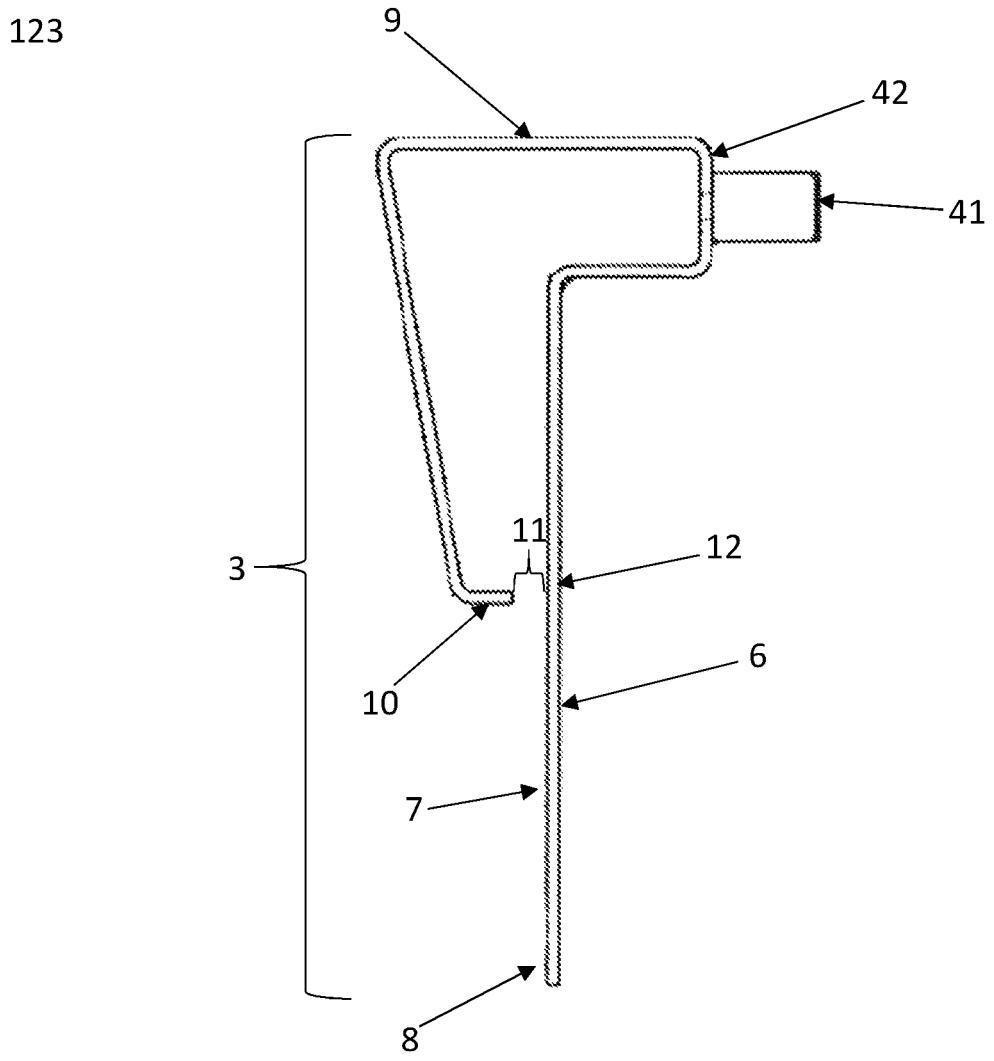
FIG. 3B is a view of the belt attachment including the paint brush holding apparatus.
Figure 4:
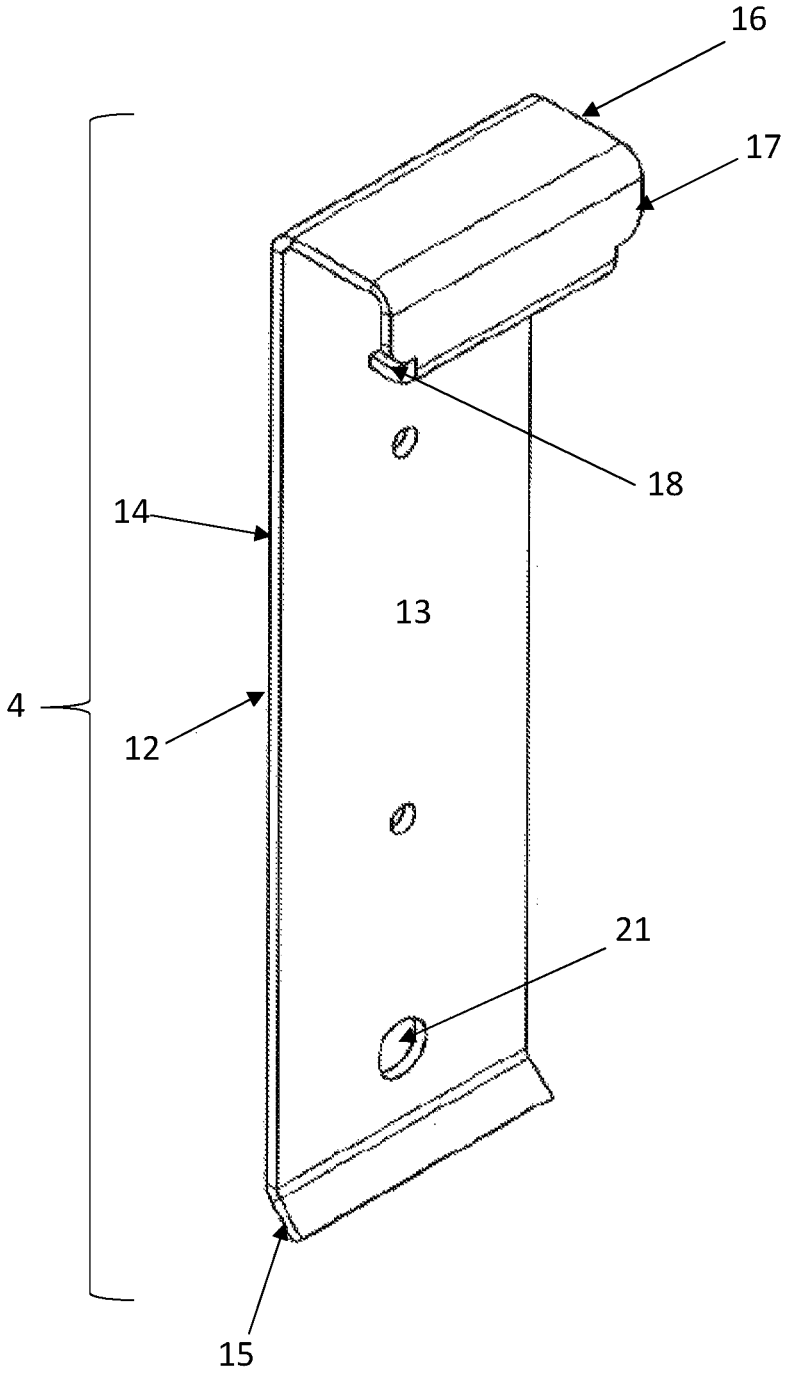
FIG. 4 view of the upper piece.
Figure 5:
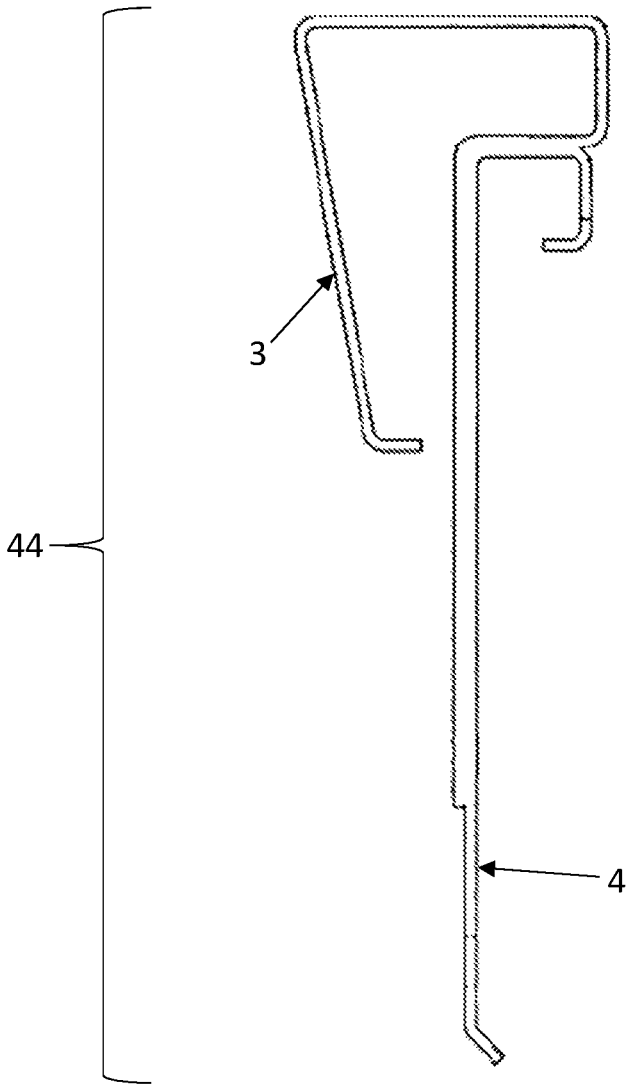
FIG. 5 is a view of the belt attachment and upper piece as a single molded piece.
Figure 6A:
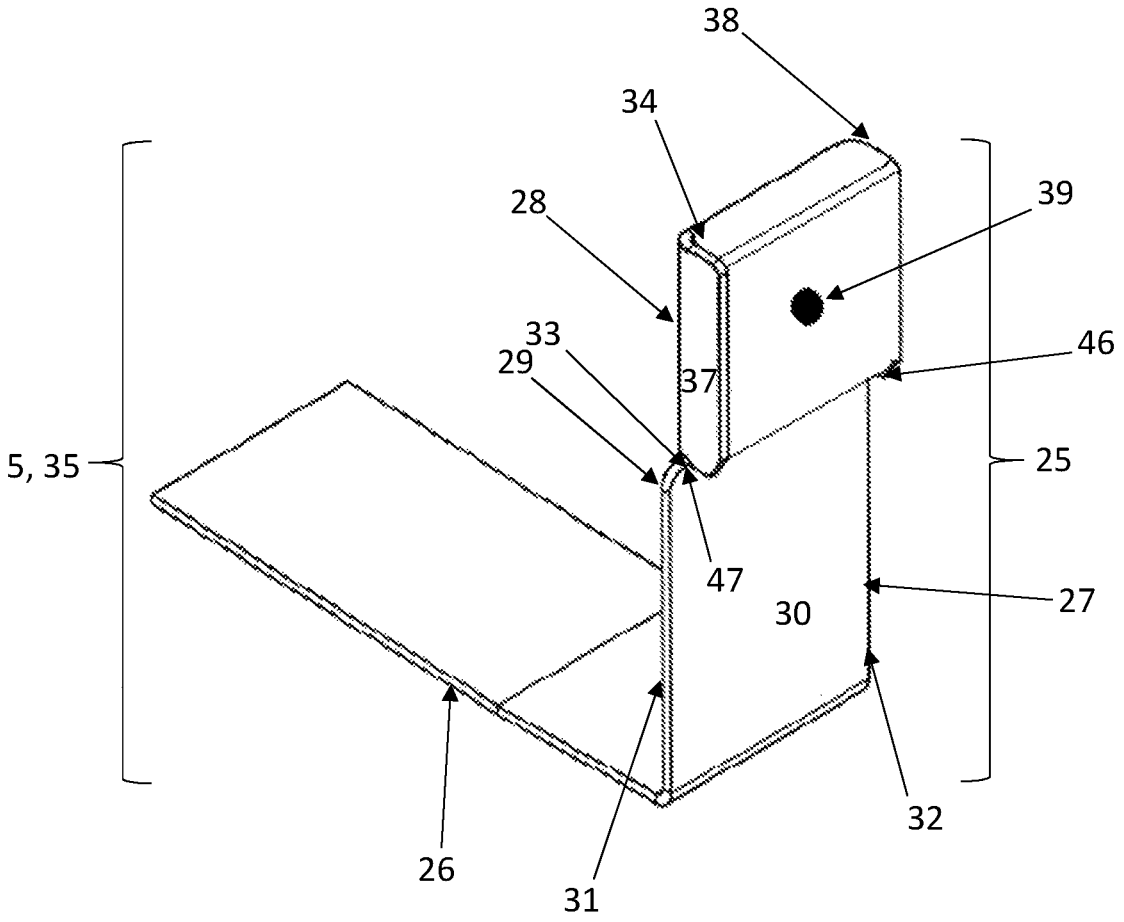
FIG. 6A is a view of the lower piece including the first embodiment of the offset.
Figure 6B:
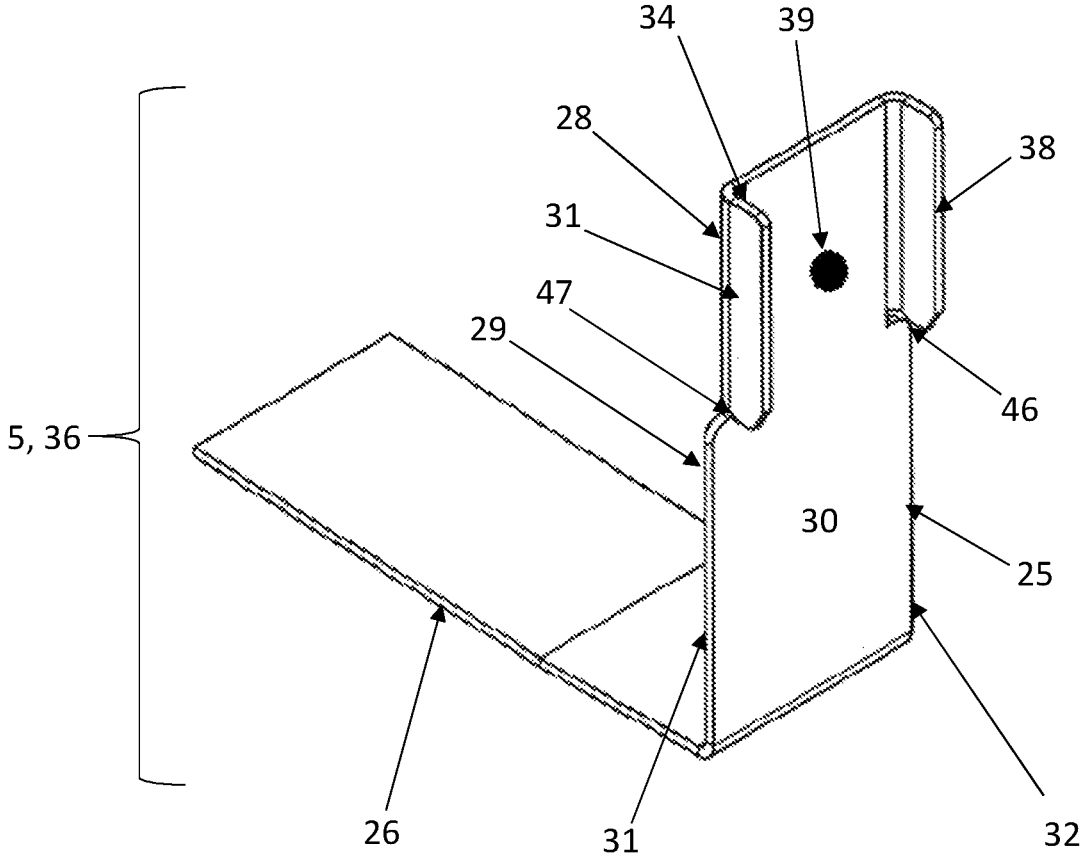
FIG. 6B is a view lower piece including the second embodiment of the offset.

The present disclosure reveals an apparatus 1 for attaching a can 2 to a belt comprising a belt attachment 3, an upper piece 4, and a lower piece 5. The belt attachment 3 comprises a face A 6, a face B 7, a bottom edge 8, and a top extension 9. The top extension 9 is formed to connect the apparatus 1 to a belt of a wearer wherein the top extension 9 extends out away from face B 7, is then angled down, and further angled back toward face B 7 to create a stop 10, wherein there is a gap 11 between the stop 10 and face B 7 to allow the belt to pass.

The upper piece 4 comprises a vertical portion 12, said vertical portion 12 comprising a face C 13 and a face D 14 and the upper piece 4 further comprises a bottom edge 15, a top piece 16, an attachment piece 17, and a hook 18. The top piece 16 of the upper piece 4 extends out from face C 13, then angles down to create the attachment piece 17, and is then angled back toward face C 13 to create the hook 18, wherein there is a gap 19 between the hook 18 and face C 13 to allow a top lip 20 of a can 2 to pass so that the upper piece 4 of the apparatus 1 is be attached to a can 2. The upper piece 4 further comprises a hole 21 that passes through face C 13 and face D 14 in the area of the bottom edge 15.

The belt attachment 3 is attached to the upper piece 4 such that face A 6 of the belt attachment 3 is aligned with face D 14 of the upper piece 4, wherein the vertical portion 12 of the upper piece 4 extends beyond the bottom edge 8 of the belt attachment 3 so that the bottom edge 8 of the belt attachment 3 and the bottom edge 15 of the upper piece 4 do not align and the hole 21 that passes through the upper piece 4 is not obstructed by the belt attachment 3. The attachment of the belt attachment 3 and the upper piece 4 is comprised of at least one of threaded fasteners, rivets, welds, and/or an adhesive. When the upper piece 4 is attached to a can 2 a gap 19 is created between face C 13 and an outer wall 24 of the can 2 to which the upper piece 4 is attached.

The lower piece 5 comprises a vertical portion 25 and a base portion 26. The vertical portion 25 comprises a lower area 27, an upper area 28, a face E 29 and a face F 30, a left edge 31 that is positioned relative to face F 30, a right edge 32 that is positioned relative to face F 30.

The upper area 28 of the vertical portion 25 of the lower piece 5 creates an offset 33 from the lower area 27 wherein the of width 34 of the offset 33 is the same as the gap 19 between face C 13 of the upper piece 4 and the outer wall 24 of the can 2, and there are two embodiments of said offset 33. In the first embodiment 35, the offset 33 is created by the displacement of the upper area 28 relative to the lower area 27 in the direction face F 30 is directed. In the second embodiment 36, the offset 33 is created by a left wing 37 and a right wing 38, wherein the left wing 37 is attached to the left edge 31 of the vertical portion 25, extends out from face F 30, and abuts against face C 13 when the apparatus 1 is assembled, and the right wing 38 is attached to the right edge 32 of the vertical portion 25, extends out from face F 30 and abuts against face C 13 when the apparatus 1 is assembled.

The upper area 28 further comprises a threaded fastener 39 that extends out from face F 30, positioned so that the threaded fastener 39 passes through the hole 21 in the upper piece 4 so that at least one of a bolt or a wing nut 40 attaches the lower piece 5 to the upper piece 4.

Any of the embodiment of the apparatus may further comprise a paint brush holder 41 such that the belt attachment 3 would further comprise a notch 42 that extends the top extension 9 out from Face A 6, and over the attachment piece 17. The notch 42 comprises an end 43 and attached to the end 43 is the paint brush holder 41 capable of holding a handle of the paint brush with bristles of the brush extend into the can.

The apparatus 1 may also be produced by having the belt attachment 3 and the upper piece 4 formed from as a single assembly 44.

In order to prevent slippage when the upper piece 4 is attached to the lower piece 5, around the threaded fastener 39 there can be a plurality of ridges 45 and around the hole 21 on face C 13 in the upper piece 4 there may be a plurality of ridges 45, and when the upper piece 4 and the lower piece 5 are attached with the use of the at least one bolt or wing nut 40, the plurality of ridges 45 around the threaded fastener 39 and the plurality of ridges 40 around the hole 21 add additional friction to prevent the upper piece 4 and the lower piece 5 from sliding.

The offset 33 of the upper area 28 of the lower piece 5 may further comprise a lower edge 46, said lower edge 46 comprising a notch 47 and being positioned such that a handle of the can 2 is inserted into the notch 47, holds the lower piece 5 in place against the can 2, to prevent the handle from flopping around and to simplify the assembly of the apparatus 1. In addition, a bottom edge 8 of the vertical portion 12 of the upper piece 4 also extends beyond the upper area 28 of the lower piece 5 and bends toward face F 30 of the lower piece 5 to further secure the handle.

What is claimed:

1. An apparatus for attaching a can to a belt comprising:

a belt attachment, an upper piece, and a lower piece;

the belt attachment comprises a face A, a face B, a bottom edge, and a top extension;

the top extension is formed to connect the apparatus to a belt of a wearer wherein the top extension extends out away from face B, is then angled down, and further angled back toward face B to create a stop;

wherein there is a gap between the stop and face B to allow the belt to pass;

the upper piece comprises a vertical portion, said vertical portion comprising a face C and a face D;

the upper piece further comprising a bottom edge, a top piece, an attachment piece and a hook;

the top piece of the upper piece extends out from face C, then angles down to create the attachment piece, and is then angled back toward face C to create the hook;

wherein there is a gap between the hook and face c to allow a top lip of a can to pass so that the upper piece of the apparatus can be attached to a can;

the upper piece further comprises a hole that passes through face C and face D in the area of the bottom edge;

the belt attachment is attached to the upper piece such that face A of the belt attachment is aligned with face D of the upper piece, wherein the vertical portion of the upper piece extends beyond the bottom edge of the belt attachment so that the bottom edge of the belt attachment and the bottom edge of the upper piece do not align and the hole that passes through the upper piece is not blocked by the belt attachment;

said attachment between the belt attachment and the upper piece is comprised of at least one of threaded fasteners, rivets, welds, and/or an adhesive;

when the upper piece is attached to a can a gap is created between face C and an outer wall of the can to which the upper piece is attached;

the lower piece comprises a vertical portion and a base portion;

the vertical portion comprises a lower area, an upper area, a face E and a face F, a left edge that is positioned relative to face F, a right edge that is positioned relative to face F;

the upper area of the vertical portion is an offset from the lower area, wherein said offset is created by the displacement of the upper area relative to the lower area in the direction face F is directed, said offset comprising a width such that the of width of the offset is the same as the gap of the upper piece; and the upper area further comprises a threaded fastener that extends out from face F, positioned so that the threaded fastener passes through the hole in the upper piece so that at least one of a bolt or a wing nut attaches the lower piece to the upper piece.

2. The apparatus of claim 1 wherein the belt attachment further comprises a notch, said notch extends the top extension out from Face A, and over the attachment piece; and the notch further comprising an end, wherein, attached to the end is a paint brush holder capable of holding a handle of the paint brush with bristles of the brush extend into the can.

3. The apparatus of claim 2 wherein the belt attachment and the upper piece are formed from as a single assembly.

4. The apparatus of claim 3 wherein on the upper area of the lower piece around the threaded fastener are a plurality of ridges;

on face C around the hole in the upper piece are a plurality of ridges; and when the upper piece and the lower piece are attached with the use of the at least one bolt or wing nut, the plurality of ridges around the bolt and the plurality of ridges around the hole add additional friction to prevent the upper piece and the lower piece from sliding.

5. The apparatus of claim 4 wherein the offset of the upper area of the lower piece further comprises a lower edge, said lower edge comprising a notch and being positioned such that a handle of the can is inserted into the notch, holds the lower piece in place against the can; and the bottom edge of the vertical portion of the upper piece extends beyond the upper area of the lower piece and bends toward face F of the lower piece.

6. The apparatus of claim 1 wherein the belt attachment and the upper piece are formed from as a single assembly.

7. The apparatus of claim 6 wherein on the upper area of the lower piece around the threaded fastener are a plurality of ridges;

on face C around the hole in the upper piece are a plurality of ridges; and when the upper piece and the lower piece are attached with the use of the at least one bolt or wing nut, the plurality of ridges around the bolt and the plurality of ridges around the hole add additional friction to prevent the upper piece and the lower piece from sliding.

8. The apparatus of claim 7 wherein the offset of the upper area of the lower piece further comprises a lower edge, said lower edge comprising a notch and being positioned such that a handle of the can is inserted into the notch, holds the lower piece in place against the can; and the bottom edge of the vertical portion of the upper piece extends beyond the upper area of the lower piece and bends toward face F of the lower piece.

9. The apparatus of claim 1 wherein on the upper area of the lower piece around the threaded fastener are a plurality of ridges;

on face C around the hole in the upper piece are a plurality of ridges; and when the upper piece and the lower piece are attached with the use of the at least one bolt or wing nut, the plurality of ridges around the bolt and the plurality of ridges around the hole add additional friction to prevent the upper piece and the lower piece from sliding.

10. The apparatus of claim 9 wherein the offset of the upper area of the lower piece further comprises a lower edge, said lower edge comprising a notch and being positioned such that a handle of the can is inserted into the notch, holds the lower piece in place against the can; and the bottom edge of the vertical portion of the upper piece extends beyond the upper area of the lower piece and bends toward face F of the lower piece.

11. The apparatus of claim 1 wherein the offset of the upper area of the lower piece further comprises a lower edge, said lower edge comprising a notch and being positioned such that a handle of the can is inserted into the notch, holds the lower piece in place against the can; and the bottom edge of the vertical portion of the upper piece extends beyond the upper area of the lower piece and bends toward face F of the lower piece.

12. An apparatus for attaching a can to a belt comprising:

a belt attachment, an upper piece, and a lower piece;

the belt attachment comprises a face A, a face B, a bottom edge, and a top extension;

the top extension is formed to connect the apparatus to a belt of a wearer wherein the top extension extends out away from face B, is then angled down, and further angled back toward face B to create a stop;

wherein there is a gap between the stop and face B to allow the belt to pass;

the upper piece comprises a vertical portion, said vertical portion comprising a face C and a face D;

the upper piece further comprising a bottom edge, a top piece, an attachment piece and a hook;

the top piece of the upper piece extends out from face C, then angles down to create the attachment piece, and is then angled back toward face C to create the hook;

wherein there is a gap between the hook and face c to allow a top lip of a can to pass so that the upper piece of the apparatus can be attached to a can;

the upper piece further comprises a hole that passes through face C and face D in the area of the bottom edge;

the belt attachment is attached to the upper piece such that face A of the belt attachment is aligned with face D of the upper piece, wherein the vertical portion of the upper piece extends beyond the bottom edge of the belt attachment so that the bottom edge of the belt attachment and the bottom edge of the upper piece do not align and the hole that passes through the upper piece is not blocked by the belt attachment;

said attachment between the belt attachment and the upper piece is comprised of at least one of threaded fasteners, rivets, welds, and/or an adhesive;

when the upper piece is attached to a can a gap is created between face C and an outer wall of the can to which the upper piece is attached;

the bottom piece comprises a vertical portion and a base portion;

the vertical portion comprises a lower area, an upper area, a face E and a face F, a left edge that is positioned relative to face F, a right edge that is positioned relative to face F;

the upper area of the vertical portion creates an offset from the lower area, wherein said offset is created by a left wing and a right wing, wherein the left wing is attached to the left edge of the vertical portion, extends out from face F, and abuts against face C, and the right wing is attached to the right edge of the vertical portion, extends out from face F and abuts against face C;

wherein the offset created by the left wing and the right wing of the upper area relative to the lower area comprises a width such that the of width of the offset is the same as the gap of the upper piece;

the upper area further comprises a threaded fastener that extends out from face F, positioned so that the threaded fastener passes through the hole in the upper piece so that at least one of a bolt or a wing nut attaches the lower piece to the upper piece; and the base portion extends out from face E to go below the can, comprising at least one of a hook that can be positioned on an inside lip of the base of the can or an extension that extends beneath a bottom of the can and up toward the can.

13. The apparatus of claim 12 wherein the belt attachment further comprises a notch, said notch extends the top extension out from Face A, and over the attachment piece; and the notch further comprising an end, wherein, attached to the end is a paint brush holder capable of holding a handle of the paint brush with bristles of the brush extend into the can.

14. The apparatus of claim 13 wherein the belt attachment and the upper piece are formed from as a single assembly.

15. The apparatus of claim 13 wherein the offset of the upper area of the lower piece further comprises a lower edge, said lower edge comprising a notch and being positioned such that a handle of the can is inserted into the notch, holds the lower piece in place against the can; and the bottom edge of the vertical portion of the upper piece extends beyond the upper area of the lower piece and bends toward face F of the lower piece.

16. The apparatus of claim 12 wherein the belt attachment and the upper piece are formed from as a single assembly.

17. The apparatus of claim 16 wherein the offset of the upper area of the lower piece further comprises a lower edge, said lower edge comprising a notch and being positioned such that a handle of the can is inserted into the notch, holds the lower piece in place against the can; and the bottom edge of the vertical portion of the upper piece extends beyond the upper area of the lower piece and bends toward face F of the lower piece.

18. The apparatus of claim 12 wherein the offset of the upper area of the lower piece further comprises a lower edge, said lower edge comprising a notch and being positioned such that a handle of the can is inserted into the notch, holds the lower piece in place against the can; and the bottom edge of the vertical portion of the upper piece extends beyond the upper area of the lower piece and bends toward face F of the lower piece.

* * * * *